United States Patent [19]

Rundell et al.

[11] 4,345,947

[45] Aug. 24, 1982

[54] CLARIFICATION OF GLUCOSE SYRUPS

[75] Inventors: John T. Rundell, Keston; Paul R. Pottage, Bromley; Ronald J. Harradine, Caterham, all of England

[73] Assignee: Tate & Lyle Limited, England

[21] Appl. No.: 258,440

[22] Filed: Apr. 28, 1981

[51] Int. Cl.[3] ..... C13K 1/00; C13K 1/06

[52] U.S. Cl. ..... 127/48; 127/57

[58] Field of Search ..... 127/48, 57

[56] References Cited

U.S. PATENT DOCUMENTS

| | | | |
|---|---|---|---|
| 3,508,965 | 4/1970 | Harrison | 127/57 |
| 3,853,616 | 12/1974 | Rundell | 127/48 |
| 3,909,287 | 9/1975 | Rundell | 127/57 |
| 3,926,662 | 12/1975 | Rundell | 127/57 X |
| 4,288,551 | 9/1981 | Gudnason | 127/57 X |

*Primary Examiner*—Sidney Marantz

*Attorney, Agent, or Firm*—Ostrolenk, Faber, Gerb & Soffen

[57] ABSTRACT

Hydrolyzed corn or other starch is clarified by a process which comprises forming in the syrup at a pH of 3.5 to 6.5 a primary floc formed between aluminum ions, hydroxide ions, and phosphate ions; aerating the syrup containing the primary floc; distributing an anionic organic polymeric flocculant through the aerated syrup to initiate the formation of a secondary floc; allowing the secondary floc to grow, and to segregate by flotation; and separating flocculated solids from clarified syrup.

15 Claims, 1 Drawing Figure

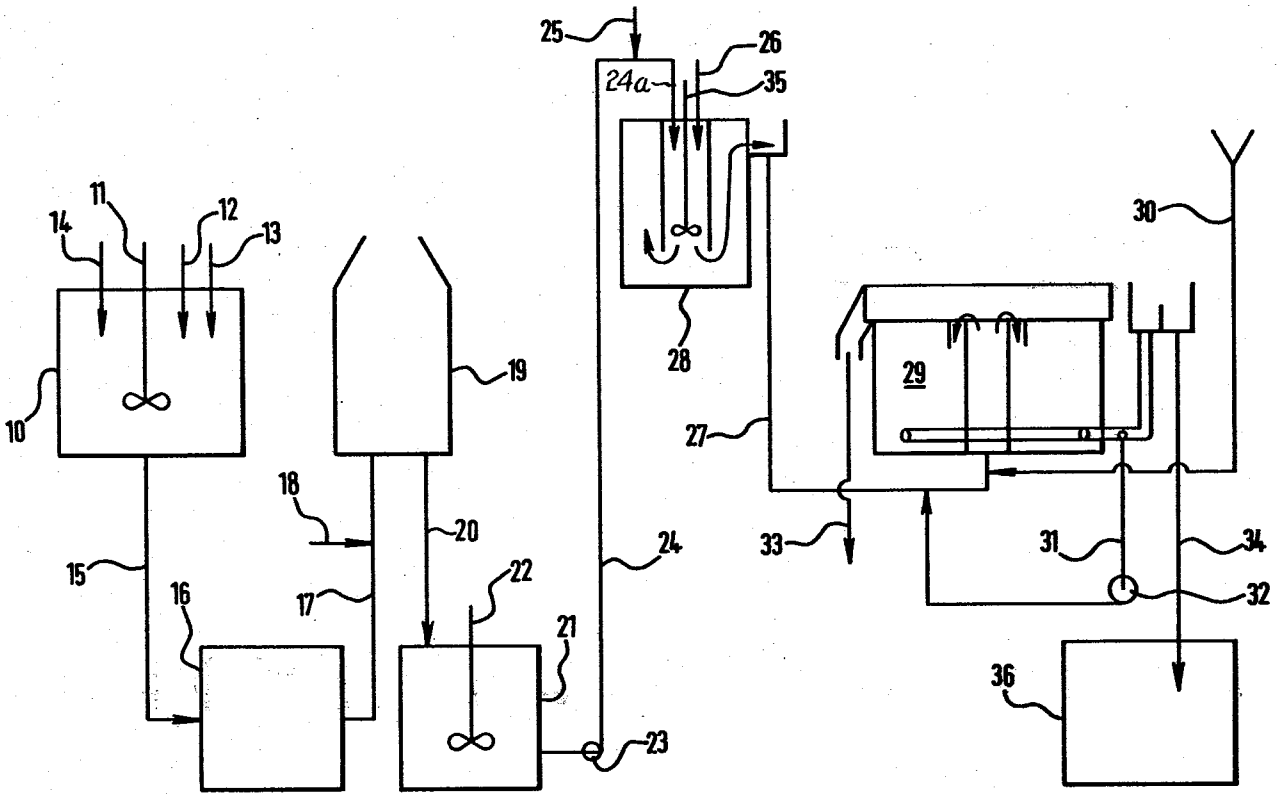
10
11
12
13
14
15
16
17
18
19
20
21
22
23
24
24a
25
26
27
28
29
30
31
32
33
34
35
36

CLARIFICATION OF GLUCOSE SYRUPS

The present invention relates to the clarification of hydrolysed starch syrups.

Hydrolysis of starch gives a syrup containing a variety of saccharides, including glucose. The hydrolysis is effected using acid and/or enzyme procedures. These procedures are well documented in the patent and other literature, and are practised on an industrial scale. It is thus unnecessary to describe them now in detail.

Put briefly, starch from a natural source, such as maize (i.e. the cereal known in the U.S.A. and elsewhere as 'corn'), is usually liquefied and thinned using hydrochloric or other acid, or using an enzyme preparation containing an $\alpha$-amylase. The thinning can give a syrup of up to 50 DE or sometimes higher ("DE" or "Dextrose Equivalent" being the percentage of solids present as reducing sugars and determined as equivalents of dextrose), but, in order to obtain DEs above about 45 DE, it is customary to effect a saccharification using an enzyme preparation typically containing an amylo-glucosidase. It will be appreciated that for syrups of high DE, say 60 DE or above, it is essential to employ an acid-enzyme or a enzyme-enzyme procedure.

Whichever procedure is employed, the crude syrup obtained as product will contain impurities derived from the original starch source. Thus, for instance, a crude syrup from maize, i.e. a crude corn syrup, will contain oils, fats, proteinaceous material and fine fibre derived from the maize. Similar impurities are encountered in hydrolysed starch syrups derived from other starch sources, such as wheat or potatoes.

In a conventional process for improving the purity of crude hydrolysed starch syrups, a clarification is performed by centrifuging the syrup and then filtering it using precoated filters. However, the centrifuging and filtration processes are difficult and time-consuming, require costly equipment and involve the use of large quantities of filter aid.

In U.K. patent specification No. 1,397,927 there is described and claimed a process for the separation of suspended solids from an aqueous liquor. This process, which is often referred to as the "retention-flocculation process", comprises: forming a primary floc in the liquor containing suspended solids; aerating the liquor containing the primary floc, with agitation; distributing an organic polymeric flocculant uniformly throughout the liquid phase of the aerated liquor to initiate the formation of a secondary floc therein; retaining the resulting mixture in a flocculator vessel with non-turbulent agitation preventing the segregation of the secondary floc from the liquor and allowing the secondary floc to grow; transferring the liquor, with minimal agitation, from the flocculator vessel to a separator vessel; allowing the secondary floc to segregate by flotation from the liquor in the separator vessel; and separately removing clarified liquor and flocculated solids from the separator vessel.

This earlier invention is applicable to a wide range of processes requiring the separation of suspended solids from an aqueous liquid, for example in brewing, water purification treatments, the treatment of sewage and industrial effluents, and mineral ore separation processes. However, the invention is particularly useful for separating suspended solids from sugar liquors, syrups or juices, during the various stages of sugar manufacture.

The retention-flocculation process can be used, for example, in the manufacture of sucrose, but this is not the only sugar to whose manufacture it can be applied. More specifically, the retention-flocculation process can be useful for separating suspended solids from hydrolysed starch syrups.

The present inventors have been investigating this application of the retention-flocculation process to the clarification of hyrolysed starch syrups, and in so doing have developed an improved process which offers specific advantages over the process known from U.K. patent specification No. 1,397,927. The new processes can be generally applied to the clarification of hydrolysed starch syrups, and in particular to high DE glucose syrups prepared by the acid-enzyme or enzyme-enzyme procedures ("High DE Syrups") and to low DE glucose syrups prepared by acid or enzyme liquefaction and thinning without the subsequent enzyme saccharification ("Low DE Syrups").

More particularly, in accordance with the present invention there is provided a novel process for the clarification of a hydrolysed starch syrup. The present process comprises forming in the syrup, at a pH of 3.5 to 6.5, a primary floc formed between aluminium ions, hydroxide ions and phosphate ions; aerating the syrup containing the primary floc; distributing an anionic organic polymeric flocculant through the aerated syrup to initiate the formation of a secondary floc; allowing the secondary floc to grow, and to segregate by flotation; and separating flocculated solids from clarified syrup.

The present invention is founded upon the discovery that there is a particular reagent system-aluminum ions/hydroxide ions/phosphate ions/pH 3.5 to 6.5—which gives a primary floc optionally capable of entraining unwanted material from hydrolysed starch syrups. This reagent system is different from those in U.K. patent specification No. 1,397,927 and gives rise to a basic aluminium phosphate floc. It is this floc which is especially suited for removing from crude hydrolysed starch syrups the proteinaceous and other matter which it is difficult to remove completely using the known retention-flocculation process.

Compared to the conventional centrifuging and filtration procedure currently employed for clarifying hydrolysed starch syrup, the present process can offer the following advantages:

(i) large quantities of filter aid are not needed; Thus clarification costs are substantially reduced as are the present problems associated with disposal of large quantities of used filter aid; and (ii) expensive centrifuge equipment and a large filter station are not required, effecting appreciable saving in equipment, maintenance and operational costs.

In the present process, the aluminum ions are preferably added as aluminum sulphate, though this is not critical, and other aluminum compounds, for example potassium aluminium sulphate or aluminum chloride, can be used.

In the primary floc, the ion ratio of aluminum ions to phosphate ions is typically more than 1:1, with a ratio of more than 3 aluminum ions to 1 phosphate ion being particularly common. For most syrups, the amounts of added aluminum (calculated as aluminum and expressed as ppm on weight of syrup) will lie in the range 5 to 100 ppm, preferably 20 to 40 ppm. Crude hydrolysed starch syrups often contain residual levels of free phosphate, and it is not always necessary to add all of the phosphate ion required for formation of the floc. Indeed, for some phosphate-containing syrups it may not be necessary to add any phosphate ions at all. A simple quantitative analysis of the crude syrup before adding phosphate ions permits due allowance to be made for any phosphate ions already present. As a general rule, it is unnecessary to make allowance for aluminum ions already present since the crude syrups usually contain less than 1 ppm of aluminum. Where insufficient phosphate ions are present for reaction with the aluminum, it is preferred to raise the level to up to 50 ppm, more preferably 25 ppm of phosphate ions (calculated as $P_2O_5$ and expressed as ppm on weight of syrup) by adding phosphate. Phosphate ions are preferably added as phosphoric acid, though again other phosphate compounds, for example sodium phosphate ($Na_2HPO_4$) can be used.

For example, the following reagents and quantities are appropriate:

(i) 2.6 kg of $AlCl_3.6H_2O$ is dissolved in 4 $dm^3$ of water and 0.194 kg of 85% $H_3PO_4$ is added. This reagent is suitable for treatment of syrup from a 10 ton batch of starch.

(ii) 2.42 Kg of aluminum sulphate, $Al_2(SO_4).16H_2O$ is added at 340 ppm (calculated on weight of syrup) to seven tonnes of crude syrup, followed by 170.5 g of 85% phosphoric acid.

(iii) Aluminum chloride and phosphoric acid are dissolved in water to provide a reagent which is added to crude syrup at 53 ppm $Al_2O_3$ and 5 ppm phosphoric acid, calculated on weight of syrup.

(iv) Phosphoric acid, corresponding to 6 ppm $P_2O_5$, and a soluble aluminum salt, corresponding to 53 ppm of $Al_2O_3$, calculated on weight of syrup, are added to syrup to be clarified.

(v) Aluminum sulphate, potassium aluminium sulphate, aluminum chlorohydrate or poly aluminum chloride, 50 ppm $Al_2O_3$, and disodium hydrogen phosphate or phosphoric acid, 6 ppm $P_2O_5$, calculated on weight of syrup, are added to syrup to be clarified.

(vi) 3.08 liter of 13 wt% aluminum sulphate solution is added to 1000 liter of High DE Syrup already containing over 100 ppm $P_2O_5$ (the added aluminum amounting to 29.3 ppm, ppm being on weight of syrup).

It will be readily appreciated that these combinations of reagents and amounts are only illustrative—the skilled man will have no difficulty in formulating other combinations.

Low DE Syrup produced from starch by the acid hydrolysis procedures typically has a pH around 1 to 3, and in accordance with the present process, it is essential to adjust the pH to lie within the range of 3.5 to 6.5 for formation of the primary floc. The adjustment of pH is preferably effected in two stages with intervening addition of the aluminum ions and, if needed, phosphate ions. Firstly alkali is added to stop the hydrolysis reaction and to effect a crude adjustment of the pH to, say, pH 4.5; secondly the aluminum and phosphate ions are added; and, thirdly, further alkali is added to effect a fine adjustment to the desired pH of, say, 4.5. The pH adjustment is most conveniently carried out by adding sodium carbonate solution. However, other reagents, e.g. sodium hydroxide, can be used.

Low DE Syrup produced from starch by enzyme hydrolysis procedures typically has a pH around 6 to 7. To gain the necessary pH of 3.5 to 6.5, it is preferred first to add the aluminum and phosphate ions, thereby giving a pH of about pH 5. Thereafter, acid such as hydrochloric acid is added to gain the desired pH of say pH 4.5.

High DE Syrup produced from starch by acid-enzyme dual procedures or by enzyme-enzyme procedures typically has a pH of around 4 to 5 and any pH adjustment is preferably best effected by addition of the intended amount of aluminum and phosphate ions, followed by alkali as required to gain the desired pH.

In forming the primary floc with a pH adjustment, it is possible to add last the respective sources of phosphate and aluminum ions: in such instances the amount of acid or alkali needed to give the desired final pH has first to be determined by experiment or calculation.

Whatever the reagents employed, it is a critical feature of the present invention that the pH should lie within the range of 3.5 to 6.5 during the formation of the primary floc. It is most noticeable that an effective clarification is not obtained if the pH lies outside this range during growth of the primary floc. For best results, a pH of 4 to 5 is appropriate, especially about pH 4.5 to 4.7.

After formation of the primary floc, the syrup is aerated. Aeration is preferably carried out using agitation as described in U.K. patent specification No. 1,397,927. Aeration can be carried out directly on the syrup containing the primary floc, or on another liquid which is then added to the floc-containing syrup. In a preferred process, part of the clarified syrup produced by the process is itself aerated and added back to the floc-containing syrup, thereby indirectly effecting the desired aeration. For example, from 10 to 50%, usually 15 to 30% of the clarified syrup can be diverted from the product stream, aerated, and added to the incoming stream of floc-containing syrup.

After the direct or indirect aeration of the syrup containing the primary floc, an anionic organic polymeric flocculant is distributed therethrough to initiate the formation of a secondary floc. Although the known retention-flocculation process works with other flocculants, we limit the present process to anionic flocculants. Suitable flocculants are widely available and include the anionic polyacrylamides, particularly those with a molecular weight above 1,000,000. Especially preferred are the anionic polyacrylamides with a molecular weight of 5,000,000 to 10,000,000 and having a charge density of 20 to 75% by weight acrylate units, such as the anionic polyacrylamides sold under the Registered Trade Marks "TALOFLOTE" and "TALODURA". For most purposes, from 1 to 20 ppm by weight of flocculant in the syrup is suitable, with a preferred range being 3 to 8 ppm.

The secondary floc is then allowed to grow, and to segregate by flotation. In a preferred embodiment of the present process, the growth and segregation is achieved by retaining the mixture in a flocculator vessel with non-turbulent agitation preventing the segregation of the secondary floc and thereby allowing it to grow, transferring the syrup with minimal agitation from the flocculator vessel to a separator vessel, and then allowing the secondary floc to segregate by flotation from the syrup. Suitable equipment comprises a "TALO" (Registered Trade Mark) clarifier available from Tate & Lyle Ltd; such clarifiers represent apparatus as described and claimed in the U.K. patent specification No. 1,397,927. Suitable residence times and other operating conditions are also described in No. 1,397,925.

After segregation of the secondary floc, the flocculated solids are separated from clarified syrup. The separation may be effected by employing different outlets in the separator or other vessel containing the syrup and solids (as in a TALO clarifier), or by withdrawing first the syrup and then the solids using a common outlet: the former is more appropriate for continuous operation whereas the latter is more appropriate for batch operation.

The present invention is further illustrated by the following non-limiting examples.

In Example 1, reference is made to the accompanying drawings, wherein:

The FIGURE is a flow diagram for a process for producing corn syrup using a clarification in accordance with the invention.

EXAMPLE 1—First Large-scale Process

This Example is based on experimental work carried out at a factory in Britain which had previously used a conventional 2-stage filtration to clarify the corn syrup.

Referring to the drawing, a vessel 10 for preparation of starch slurry was equipped with a stirrer 11 and inlets 12, 13 and 14 respectively for starch, water and hydrochloric acid. From the vessel 10, a pipe 15 led to an acid converter 16 of conventional construction. A pipe 17 then led to a flash tank 19, with pipe 18 being provided for addition of sodium carbonate solution to liquid in pipe 17.

From the flash tank 19, a pipe 20 led to a buffer tank 21 equipped with a stirrer 22 for uniform mixing of the neutralised syrup. A pump 23 was provided to pump the syrup through pipe 24 to inlet 24*a* of a reaction tank 28. Pipe 25 served for addition of premixed aluminum ion/-phosphate ion reagent to the syrup in pipe 24. The reaction tank 28 had a stirrer 35, an inlet 26 for feeding in of sodium carbonate, and an outlet for gravity feeding of the syrup through a pipe 27 to a TALO clarifier 29. This clarifier 29 was of substantially the same construction as the apparatus shown in FIG. 2 of U.K. patent specification No. 1,397,927 and further description is not needed in the present specification.

A feed 30 was provided for addition of polyacrylamide flocculant (TALOFLOTE A5 solution, molecular weight about 7,000,000 and charge density about 47% acrylate) to liquid flowing into the clarifier 29. Liquid separated from the clarifier was mainly drawn off by pipe 34, though there was a recycle loop 31 with centrifugal pump 32 permitting part of the clarified syrup to be aerated and returned to the stream entering the clarifier. The clarified syrup drawn off through pipe 34 passed to a clarified syrup tank 36.

Further equipment was provided for subsequent treatment of the clarified syrup with powdered carbon and filter aid, to decolourise it, and also to allow concentration of the syrup by evaporation.

In operation, starch from inlet 12 and water from inlet 13 was mixed in the stirred vessel 10 to produce a uniformly mixed slurry (about 35% w/v). Usually, a small amount of sodium metabisulphite was added at this stage to improve the colour of the final syrup.

32% hydrochloric acid (11 N HCl) was added from inlet 14 to the vessel 10 in the ratio of approximately 1.5 liters of acid for every ton of starch slurry. The acidified slurry (pH about 1.5) was then fed to a batch converter 16 where it was heated under pressure. The slurry was heated to 125° C. and the starch converted to sugars in about 10–15 minutes, giving a syrup of 42 DE. A small amount of sodium carbonate was then added in known manner through pipe 18 to the syrup during passage of the syrup to the atmospheric flash tank 19 where it was flash-evaporated to 105° C. Carbon dioxide bubbled off from the syrup during the flash arising from the decomposition of the carbonate.

This far, the process was conventional.

If desired, the acid conversion can be replaced by an enzyme conversion. Conversion then takes place in the presence of enzyme at 106° C. and at pH 6.2, and may be followed by an additional enzyme conversion at 60° C. (saccharification) to a higher DE syrup. Acid, enzyme, acid-enzyme and enzyme-enzyme conversions are all possible.

Clarification in accordance with the invention was initiated by the formation in the reaction vessel 28 of a primary aluminum hydroxy-phosphate floc. This floc was produced by the dosing of aluminum and phosphate ions through inlet 25. Aeration of the primary floc was achieved indirectly by aeration of recycled syrup in the loop 31 using aeration pump 32. Aeration was followed by addition through feed 30 of the anionic polyacrylamide flocculant forming a secondary floc which was retained within the liquor with non-turbulent agitation for sufficient time (about 2 minutes) to allow the floc to grow in the way described in U.K. patent specification No. 1,397,927. After the appropriate residence time, the floc-containing liquor flowed into a separator chamber of the clarifier 29, and the secondary floc floated to the surface as a scum. The floated floc containing proteins and fats, was removed as a scum by a rotary scraper blade and drawn off through pipe 33. The clarified syrup was fed to a tank where carbon and filter aid were added, and the syrup was then filtered using six plate-and-frame filters. The process was operated so as to give a 42 DE syrup of essentially the same clarity as had previously been obtained by the conventional method, that is, a syrup of about 20 ppm turbidity.

The amounts of reagents used in the present treatment were very small and consisted of:

5 ppm $P_2O_5$ calculated on 40 wt.% syrup, added as phosphoric acid.

28 ppm of Al calculated on the syrup, added as aluminum sulphate.

about 5 ppm of TALOFLOTE calculated on the syrup, added as an 0.1% solution.

0.138% of carbon, calculated on the syrup.

0.055% of filter aid, calculated on the syrup.

0.9% of the glucose in the converted starch was lost in the scum produced in the clarifier, and the total sludge to be discharged amount to 1.56%, calculated on the weight of the syrup.

In contrast, the conventional clarification previously used to produce the same syrup used to need more equipment, more chemicals and gave greater glucose losses and greater sludge volumes. Thus, previously it had been necessary to employ a two-stage filtration with carbon and filter aid added in both stages. The first stage was based on ten plate-and-frame filters, and the second stage on three such filters. 0.175% carbon and 0.16% filter aid were previously used, the glucose loss was 1.5%, and the total sludge amounted to 2.6%, all calculated on the weight of syrup.

The clarification procedure of the invention thus gave substantial advantages.

EXAMPLE 2—Second Large Scale Process

This Example is based on experimental work carried out at a factory in the U.S.A. The equipment was substantially as shown in the accompanying drawing, except for two modifications. Firstly, the acid converter 16 and associated equipment was replaced with conventional equipment for carrying out a dual enzyme-enzyme hydrolysis to give a high DE syrup. Secondly, at the junction between the pipe 27 from the reaction tank 28 and the return loop from the centrifugal pump 32, a holding tank was installed to even out flow into the clarifier 29.

The enzyme-enzyme converter was operated in conventional manner to produce 97 DE syrup containing about 35% by weight of dissolved solids. The syrup contained 0.5% suspended solids and was thus very turbid. The solids themselves comprised about 25% oil and fat, about 22% protein and about 3% fibre and other matter. The syrup contained about 116 ppm of phosphate and about 0.2 ppm of aluminum.

After adjustment of the pH of the syrup to 4.3, it was fed at about 1600 parts by volume per minute to the reaction tank 28. 4.92 parts by volume per minute of 13% aluminum sulphate ($Al_2(SO_4)_3.16H_2O$) solution was added, along with sufficient 2% sodium hydroxide solution to give a pH of 4.2. No phosphate was needed in view of the high initial phosphate content of the syrup.

The syrup then passed through the holding tank to the clarifier 29. 7 parts by volume per minute of a 0.1% solution of TALOFLOTE A5 was metered in through the line 30. Clarified syrup was continuously drawn off through the pipe 34 and through the recycle loop 31. 30% the syrup (by volume of syrup passing through the clarifier) was drawn off through the loop 31, aerated with 30 parts by volume per minute of air using the pump 32, and cycled to the holding tank mentioned above.

The product syrup drawn off through the pipe 34 was exceptionally clear, containing only 25 ppm of suspended solids and having 70% transmission at 395 nm, so that only a polish filtration was required to give a fully clarified syrup. Using a pressure leaf filter, the filter aid consumption amounted to no more than 0.07% calculated on the syrup when using a flow rate of about 70 liters per square foot per hour.

Scum from the clarifier was drained off through pipe 33 at about 80 parts by volume per minute. It contained 11.47% suspended solids comprising 37.5% protein, 40% oil and fats and 22.5% fibres, etc.

The installation of the process of the invention was regarded as very successful. The savings in equipment and chemicals were considerable, compared to a conventional installation, and syrup of consistently high quality was obtained.

EXAMPLE 3—Small Scale Investigations 100 ml of 15 DE enzyme-thinned syrup at about pH 6.3 and containing about 150 ppm of phosphorus (calculated as $P_2O_5$) was treated with 0.4 ml of 0.2 M $Al_2(SO_4)_3.16H_2O$ solution (36 ppm Al on syrup) and then with sufficient dilute hydrochloric acid to give a pH of 4.4.

The syrup was then aerated by agitation and 0.5 ml of 0.1% TALOFLOTE A5 solution (about 5 ppm flocculant on syrup) was mixed in with non-turbulent agitation. Separation was then allowed to ensue for 5 minutes, giving a floated mud volume of about 10% and about 90% clear syrup.

In contrast to the initial, very turbid syrup, the clarified syrup was very clear and contained less than 50 ppm of suspended solids.

Taking this experiment as a standard, variations were then introduced to establish the latitude which might be possible. With each variation, a subjective assessment was made, relative to the standard experiment.

In this way, it was established that, for the particular syrup being treated, comparable results could be obtained using 20 to 45 ppm Al, with more than 45 ppm aluminum giving no apparent advantage.

Working at 30 ppm Al, it was found that from 5 to 30 ppm $P_2O_5$ gave the best results, with more than 30 ppm phosphate again giving no apparent advantage.

The flocculant dose could be varied between 2.5 and 10 ppm when using 35 ppm Al, and when using 34 ppm Al the flocculant type could be varied between charge densities of 30 to 60% by weight acrylate.

Results comparable to the standard were also obtained when the hydrochloric acid was used to give a pH of 4 or a pH of 5.

With substantial departure from the ranges mentioned, it was found that the clarification was less effective for the syrups under investigation.

EXAMPLE 4—Process Including De-Sweetening of Flocculated Scum 4.8 ml of prepared primary reagent (containing 26 ppm Al and 12 ppm $P_2O_5$ on solution weight) was added to 800 ml 97 DE corn syrup of 40% solids which had been heated to 75° C. on a water bath. The pH of the solution was adjusted to 5 by the addition of a few drops of sodium hydroxide solution (1 M). The treated syrup was quickly aerated in a blender (a food mixer) and 4 ml Taloflote A5 flocculant (0.1%) solution, 5 ppm on solution weight, added with gentle sitrring. The corn syrup was left to clarify. After the clarification, the syrup subnatant was syphoned off.

The floated scum produced contained some glucose. An investigation was performed to see how much glucose was occluded in the scum and how much might be recovered by simple washing on a filter membrane.

Two separate tests were performed on the scum.

1. The amount of scum produced from 800 ml of corn syrup, directly after clarification, was determined by weighing. Deionised water (220 ml) was thoroughly mixed with the scum and the concentration of glucose solution determined.

38.43 g of scum was produced from 800 ml 40 wt.% corn syrup. After the addition of 200 ml water, a 7.70 wt.% glucose solution was obtained.

2. A sample of the scum was gently filtered on a filter cloth in a Buchner funnel. Deionized water was mixed with the resultant dry cake and the concentration of glucose dissolved in the solution was determined.

The scum gave 200 ml 0.2 wt.% liquor. This represents 0.65% original glucose. Filtration was performed quite easily, without much 'blinding' of the filter cloth. Thus, some glucose was indeed present in the scum but could be recovered by washing, should economic and other factors be favourable.

EXAMPLE 5—Comparison of a Conventional Retention-Flocculation Clarification Applied to Corn Syrup with a Clarification Treatment Embodying the Present Invention Hydrolysis of corn starch was carried out in the normal way by acidification of a corn starch slurry to pH 1.5 with hydrochloric acid followed by heat treatment under pressure. The resulting 42 DE glucose syrup contained impurities of corn oil, gluten etc. Conventionally, such a syrup is clarified by expensive diatomaceous earth filtration. In this instance, clarification was effected using either a flocculation procedure embodying the present invention, or, for comparison, a flocculation procedure based on a retention-flocculation conventionally employed for sucrose and as described in U.K. patent specification No. 1,397,297.

For the process based on the procedure of U.K. patent specification No. 1,397,297, glucose syrup at 80° C. was treated with phosphoric acid (corresponding to 370 ppm $P_2O_5$ on solids) and lime (to give pH 6). The sample was then aerated before the addition of TALODURA polyacrylamide flocculant (10 ppm on solids). Impurities were allowed to separate by flotation with retention in a TALO clarifier, and the clarified syrup was filtered through a coarse paper.

For control purposes to represent the current factory process, an aliquot of the original syrup was filtered using diatomaceous earth, producing a control sample of clean glucose syrup.

Clarity (given by optical transmission at 393 nm) and calcium levels were then assessed as follows:

| Sample | Transmission at 393 nm | | Calcium Level |
|---|---|---|---|
| | Initially | After 1 hr at 100° C. | (ppm) |
| Phosphoric acid/lime TALODURA Clarified | 71 | 40 (sample turbid) | 93 |
| Filtered (Control) | 79 | 62 | 19 |

As can be seen in the above results, clarification at pH 6.0 by the procedure based on a sucrose retention-flocculation clarification scheme has the following disadvantages:

(1) Tubidity develops in the sample after clarification (2) The calcium level of the treated syrup is substantially increased.

It is to be noted that clarification with the normal phosphoric acid/lime system cannot be carried out at a lower pH than 6.0. This is because, with the normal system, the precipitate being formed at above pH 6.0 is mainly di- or tri-calcium phosphate. Below pH 6.0 the system forms more mono-calcium phosphate, which is more soluble and thus unsuitable.

For clarification of the corn syrup in accordance with the invention, the glucose syrup at 80° C. was treated with 75% phosphoric acid (6 ppm $P_2O_5$ on syrup), aluminum sulphate ($Al_2(SO_4)_3$ $16H_2O$) (26 ppm Al on syrup) and sodium hydroxide (100 ppm on syrup).

The sample was aerated and TALOFLOTE polyacrylamide flocculant (5 ppm on syrup) then added.

Impurities were allowed to separate by flotation. Clarified syrup was filtered through a course paper before analysis. Again for comparison purposes an aliquot of the original syrup was filtered using diatomaceous earth to produce a control sample of clean glucose syrup, representing the current factory process.

| Sample | Transmission at 395 nm | | Calcium |
|---|---|---|---|
| | Initially | After 1 hr at 100° C. | (ppm) |
| From new clarification technique | 80 | 75 | 20 |

-continued

| Sample | Transmission at 395 nm | | Calcium |
|---|---|---|---|
| | Initially | After 1 hr at 100° C. | (ppm) |
| Filtered (Control) | 80 | 68 | 20 |

As can be seen in the results, clarification produced a syrup as clean as that produced by straight diatomaceous earth filtration. In addition, the syrup stability was superior to that of the filtered sample in that less colour was generated. No turbidity formed in either of the samples.

We claim:

1. A process for the clarification of a hydrolysed starch syrup, which process comprises the steps of forming in the syrup at a pH of 3.5 to 6.5 a primary floc formed between aluminum ions, hydroxide ions, and phosphate ions; aerating said syrup containing said primary floc; distributing an anionic organic polymeric flocculant through said syrup after aeration to initiate formation of a secondary floc; allowing said secondary floc to grow, and to segregate by flotation, giving flocculated solids and clarified syrup; and separating said flocculated solids from said clarified syrup.

2. The process of claim 1, wherein for said step of forming said primary floc, aluminum ions are added to said syrup in an amount of 5 to 100 ppm (calculated as aluminum and expressed as ppm on weight of syrup).

3. The process of claim 2, wherein aluminum ions are added at 20 to 40 ppm.

4. The process of claim 1, wherein the ion ratio in said primary floc of aluminum ions to phosphate ions is more than 1:1.

5. The process of claim 1, wherein for said step of forming said primary floc, allowance is made for any phosphate ions already present in said syrup.

6. The process of claim 1, wherein for said step of forming said primary floc, phosphate ions are added to said syrup to give at most 50 ppm phosphate (calculated as $P_2O_5$ and expressed as ppm on weight of syrup).

7. The process of claim 1, wherein for said step of forming said primary floc, the pH is 4 to 5.

8. The process of claim 7, wherein said pH is 4.5 to 4.7.

9. The process of claim 1, wherein said step of aerating said syrup is carried out using agitation.

10. The process of claim 9, wherein said step of aerating is carried out on a liquid which is then added to the said syrup containing said primary floc.

11. The process of claim 10, wherein a part of said clarified syrup produced by said process is aerated and added to said syrup containing said primary floc.

12. The process of claim 11, wherein said part of said clarified syrup is from 10 to 50%.

13. The process of claim 1, wherein said anionic organic polymeric flocculant is an anionic polyacrylamide with a molecular weight of 5,000,000 to 10,000,000 and a charge density of 20 to 75% by weight acrylate units.

14. The process of claim 12, wherein from 1 to 20 ppm of flocculant is employed (expressed as ppm on weight of syrup).

15. The process of claim 1, wherein said step of allowing said secondary floc to grow, and then to segregate by flotation is realized by retaining said syrup in a flocculator vessel where the syrup is subjected to non-turbulent agitation, thereby preventing the segregation of said secondary floc and allowing the secondary floc to grow, transferring said syrup with minimal agitation from said flocculator vessel to a separator vessel, and then allowing said secondary floc to segregate by flotation from said syrup.

* * * * *